US012510325B2

(12) United States Patent
Nelson

(10) Patent No.: US 12,510,325 B2
(45) Date of Patent: Dec. 30, 2025

(54) HANDS-FREE BOW HOLDER

(71) Applicant: Jonathan S. Nelson, Stillwater, MN (US)

(72) Inventor: Jonathan S. Nelson, Stillwater, MN (US)

( * ) Notice: Subject to any disclaimer, the term of this patent is extended or adjusted under 35 U.S.C. 154(b) by 37 days.

(21) Appl. No.: 18/243,615

(22) Filed: Sep. 7, 2023

(65) Prior Publication Data

US 2024/0044608 A1 Feb. 8, 2024

Related U.S. Application Data

(60) Provisional application No. 63/359,520, filed on Jul. 8, 2022.

(51) Int. Cl.
*F41B 5/14* (2006.01)

(52) U.S. Cl.
CPC ..... *F41B 5/1461* (2013.01)

(58) Field of Classification Search
CPC .... F41B 5/1461; A45F 3/10; A45F 2003/003; A45F 2003/045
USPC ..... 124/80, 86; 248/122.1
See application file for complete search history.

(56) References Cited

U.S. PATENT DOCUMENTS 4,103,807 A * 8/1978 Lyon ..... F41B 5/1461 224/675
4,341,409 A * 7/1982 Sakoda ..... H05B 6/6417 292/254
4,360,179 A * 11/1982 Roberts ..... F41B 5/14 248/126
4,621,752 A * 11/1986 Youngbauer ..... F41B 5/1461 224/916
4,684,047 A * 8/1987 Burgwin ..... F41B 5/1461 224/916
5,377,657 A * 1/1995 Foster ..... F41B 5/14 124/88
6,155,470 A * 12/2000 Robison ..... F41B 5/1461 224/259
6,244,556 B1 * 6/2001 Carrillo ..... F41B 5/14 182/187
7,527,182 B1 * 5/2009 Sherwood ..... A45F 5/02 224/916
8,814,018 B1 * 8/2014 Mozes ..... A45F 3/14 224/625

(Continued)

*Primary Examiner* — John E Simms, Jr.
(74) *Attorney, Agent, or Firm* — Robert Cantrell; Jose Jimenez; JIMENEZ LAW FIRM

(57) ABSTRACT

A hands-free bow holder has a collapsible bow holder carriage designed to open to hold an archery bow. The bow holder has a vertically disposed plate member designed to be attached to a belt member. A foldable, substantially u-shaped carriage member is pivotally coupled to the plate member and is designed to hold the bow at a lower cam of the bow when the carriage member is in an open state, substantially perpendicular to the plate member. The carriage member is folded substantially parallelly to the plate member when closed. Included is a vertically disposed v-block member wherein a concave portion of the v-block member is outwardly facing to retain the cam of the bow. The v-block member is further designed to restrain side-to-side movement of the bow. A release catch is designed to releasably retain a string member of the bow wherein the bow will be retained hands-free.

2 Claims, 6 Drawing Sheets

(56) References Cited

U.S. PATENT DOCUMENTS

| | | | | |
|---|---|---|---|---|
| 2005/0178938 | A1* | 8/2005 | Sutherland | F41B 5/14 248/309.1 |
| 2007/0215763 | A1* | 9/2007 | Krasnicki | A45F 3/44 248/156 |
| 2009/0001115 | A1* | 1/2009 | Vongnaraj | B62J 7/04 224/452 |
| 2012/0234879 | A1* | 9/2012 | Lester | A45F 3/08 224/261 |
| 2013/0233660 | A1* | 9/2013 | Bettua | A45C 7/0045 190/9 |
| 2014/0361143 | A1* | 12/2014 | May | F41B 5/1461 248/688 |
| 2021/0270561 | A1* | 9/2021 | Ochs | A01M 31/02 |

* cited by examiner

HANDS-FREE BOW HOLDER

CLAIM OF PRIORITY

This application is a continuation-in-part of U.S. provisional application with Ser. No. 63/359,520, filed on Jul. 8, 2022, which is incorporated herein by reference in its entirety.

FIELD OF THE INVENTION

The inventive concept relates generally to a hands-free bow holder system and method for hunting and other archery activities.

BACKGROUND

Carrying a bow when bow hunting involves handling the mass and weight of a bow which can, over time, become burdensome, particularly if a hunter is waiting for a period for an opportunity to shoot. Setting a bow down onto the ground or a platform is one solution, but the bow is, necessarily, placed poorly for a shot because it must be retrieved and positioned to shoot. Hook style products on the market can reduce the range of motion because such products protrude from trees or other mounts and require the user to move to free their bow to move into a shooting position. Such movement can alert game. There are also ground-mounted holders, but ground-mounted holders require users to move the holders when they move. Ground holders can also present trip hazard and may require movement that can alert game at important moments. Back slings for bows can require significant movement to bring bows forward when needed. Front body-mounted bow holders may create noise when used or may present partial solutions where the bow cannot be released hand-free, requiring users to maintain some active control of the bow while waiting or scanning for opportunity. Therefore, there is a need in the market for an improved bow holder worn by bow hunters and other participants of archery.

SUMMARY OF THE INVENTION

Disclosed is a hands-free bow holder for a user has a collapsible bow holder carriage designed to open to hold an archery bow, herein further referred to as a bow. The inventive concept further has vertically disposed plate member designed to be attached to a belt member. A foldable, substantially u-shaped carriage member is pivotally coupled to the plate member and is designed to hold the bow at a lower cam of the bow when the carriage member is in an open state. When in an open state, the carriage member is substantially perpendicular to the plate member. The carriage member is folded substantially parallelly to the plate member when the carriage member is in a closed state.

The inventive concept includes a vertically disposed v-block member wherein a concave portion of the v-block member is outwardly facing and designed to retain the cam of a bow with the bow oriented outward substantially parallelly with the v-block member that bow portion distally facing from the user. The v-block member is further designed to restrain side-to-side movement of the bow. A release catch is designed to releasably retain a string member of the bow wherein the bow will be retained hands-free.

In one embodiment of the inventive concept, the hands-free bow holder has a clip and strap member disposed substantially at a middle portion of the plate member designed to secure the carriage member, when folded, in the folded state.

In one embodiment of the hands-free bow holder, the release catch includes a J-hook or string hook designed for substantially silent use. In another embodiment, a spring-loaded slide member is used.

In one embodiment of the hands-free bow holder, at least one spring-loaded latch member is designed to retain and release the carriage member when changing the carriage member from one state to another state of open and closed states.

In one embodiment of the inventive concept, the plate member is substantially fabric.

In one embodiment of the hands-free bow holder, the plate member is at least one or more of polymer and metal.

In one embodiment of the hands-free bow holder, the plate member is covered by one or more fabric portions.

In one embodiment of the hands-free bow holder, the carriage member is substantially polymer covered, further designed for quiet operation.

In one embodiment of the hands-free bow holder, stop members are polymer covered, there being disposed on the plate member at least one or more of a bottom stop member and a top stop member for respective carriage member open and closed states, the bottom stop member retaining the carriage member substantially perpendicular to the plate member.

The inventive concept now will be described more fully hereinafter with reference to the accompanying drawings, which are intended to be read in conjunction with both this summary, the detailed description and any preferred and/or particular embodiments specifically discussed or otherwise disclosed. Inventive concepts may, however, be embodied in many different forms and should not be construed as limited to the embodiments set forth herein; rather, these embodiments are provided by way of illustration only and so that this disclosure will be thorough, complete, and will fully convey the full scope of the inventive concepts to those skilled in the art.

DETAILED DESCRIPTION OF THE INVENTION

Following are more detailed descriptions of various related concepts related to, and embodiments of, methods and apparatus according to the present disclosure. It should be appreciated that various aspects of the subject matter introduced above and discussed in greater detail below may be implemented in any of numerous ways, as the subject matter is not limited to any particular manner of implementation. Examples of specific implementations and applications are provided primarily for illustrative purposes.

Disclosed is a hands-free bow holder for a user having a collapsible bow holder carriage. A bow is defined as an archery bow as might be used for hunting or other archery activities.

Figure 1:
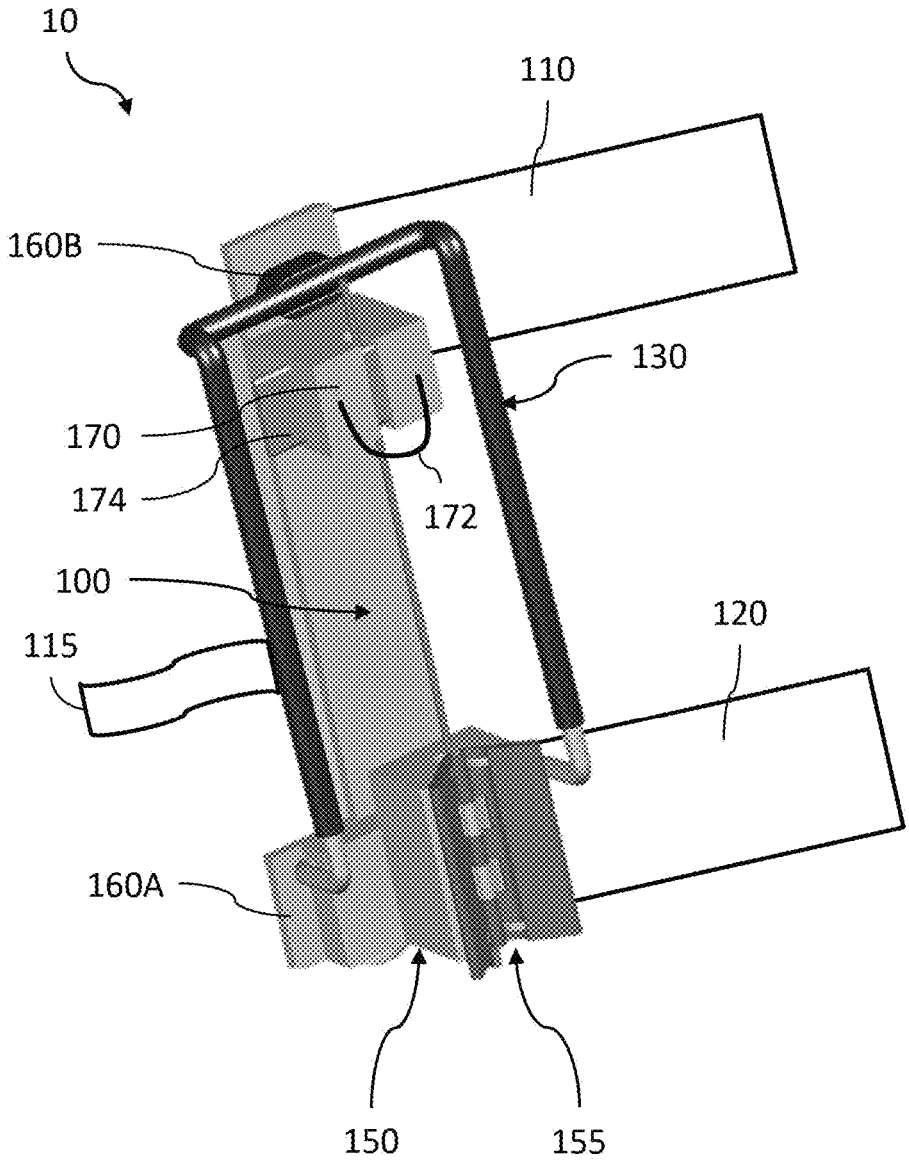
FIG. 1 illustrates a front perspective view of a representative hands-free bow holder.
Figure 2:
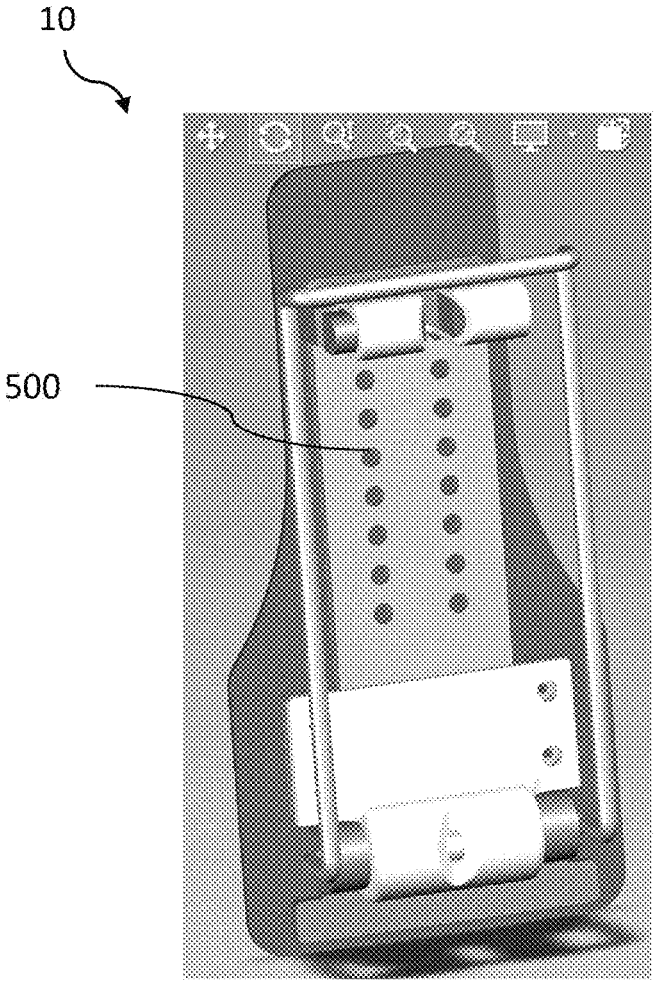
FIG. 2 illustrates a front view of another representative hands-free bow holder having belt attachments.
Figure 3:
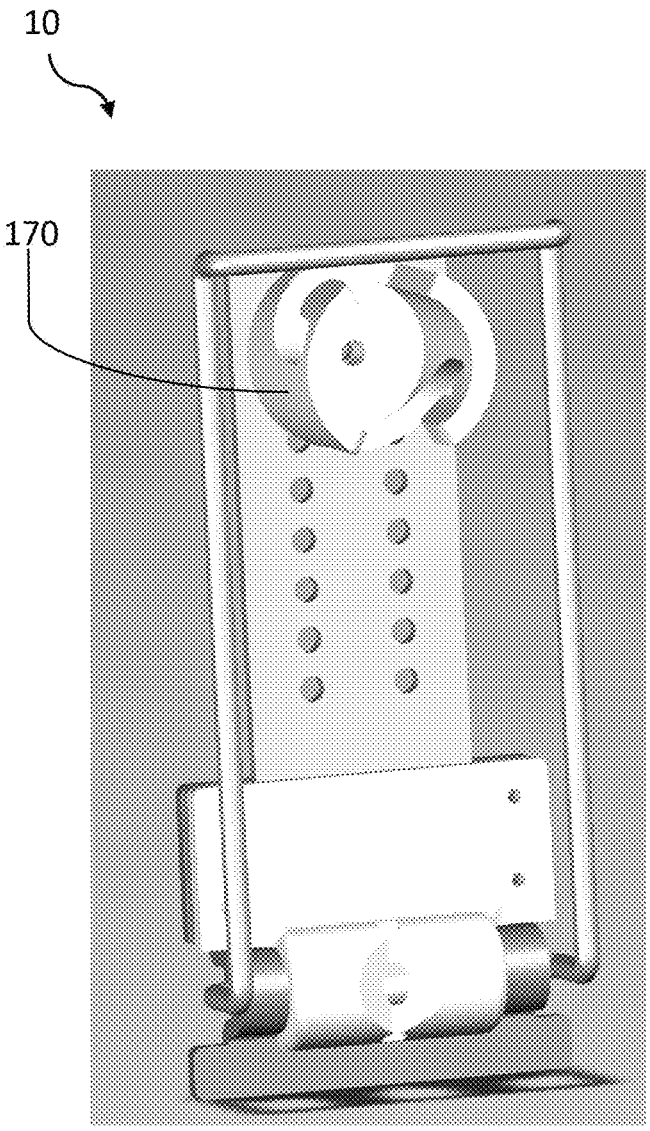
FIG. 3 illustrates a front view of another representative hands-free bow holder.

FIGS. 1-3 illustrate a representative embodiment of the bow holder 10 designed to open to hold a bow further to a vertically disposed plate member 100, the bow holder 10 designed to be attached to a belt member 110 at a top portion of the plate member 100. The belt member 110 may be an affixed part of the plate member 100 and the plate member 100 may also be a separate element that could be at least one or more of attached, clipped onto, and looped over the belt member 110, the latter including loops on the plate member 100, not shown. The plate member 100 has a leg strap member 120 at a bottom portion of the plate member 100 designed to be strapped around the user's leg. (Strap lengths are not drawn to scale.) A foldable, polymer covered, substantially u-shaped carriage member 130 is pivotally coupled to the plate member 100 designed to hold the bow at a lower cam of the bow when the carriage member 130 is in an open state. The carriage member 130 is substantially perpendicular to the plate member 100 when in an open state. The carriage member 130 is folded substantially parallelly to the plate member 100 when the carriage member 130 is in a closed state. In some embodiments, an in inwardly depressible spring-loaded latch member is designed to retain and release the carriage member 130 when changing the carriage member 130 from one state to another state of open and closed states.

FIG. 1-3 illustrate that in this representative embodiment of the hands-free bow holder 10, there is a vertically disposed v-block member 150 wherein a concave portion of the v-block member 155 is outwardly facing and designed to retain the cam of a bow with the bow oriented outward substantially parallelly with the v-block member 150 that bow portion distally facing from the user, the v-block member 150 further designed to restrain side-to-side movement of the bow. At least one or more of a polymer and polymer covered stop member 160A is disposed on the bottom portion of the plate member 100 designed to stop the carriage member 130 at substantially perpendicular to the plate member 100 when the carriage member 130 is in an open state. An adjustable release catch 170 is designed to releasably retain a string member of the bow wherein the bow will be retained hands-free.

FIGS. 1-3 further illustrates that the hands-free bow holder 10 may include a clip and strap member 115 disposed substantially at a middle portion of the plate member 100 and designed to secure the carriage member 130, when folded, in the folded state.

Figure 5:
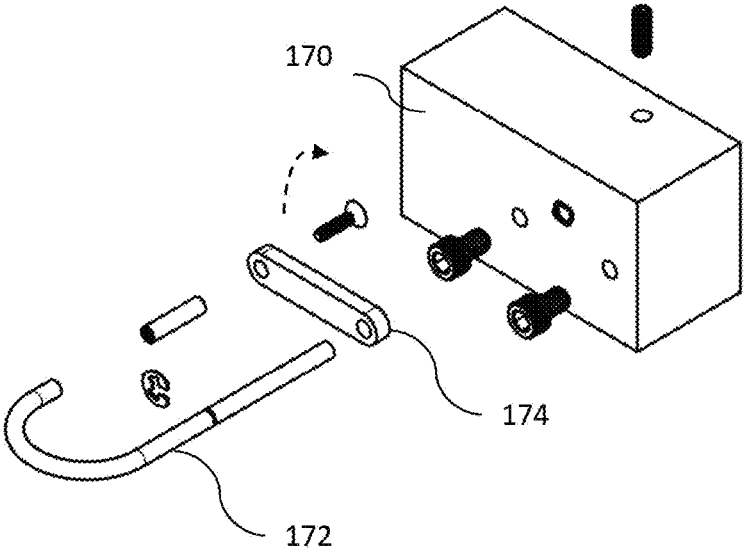
FIG. 5 illustrates a J-hook embodiment of a release catch assembly.

FIG. 1-3 further illustrates that the hands-free bow holder 10 release catch 170 may further be a string hook 172 designed for substantially silent use. Other embodiments may use a slide member 174 wherein the slide member may be spring-loaded, further illustrated in FIG. 5, and as such, may use an alternate embodiment where the string hook 172 is J-shaped.

FIGS. 1-3 further illustrate that the hands-free bow holder 10 spring-loaded latch member 140 may be inwardly disposed toward the user's center.

FIGS. 1-3 further illustrate that the hands-free bow holder 10 plate member 100 may be substantially fabric.

FIGS. 1-3 further illustrate that the hands-free bow holder 10 plate member 100 may be at least one or more of polymer and metal. Because the hands-free bow holder is intended for substantially silent use, any place on the inventive concept where one part may contact another part or with a part of the bow may be coated or made from a polymer wherein the polymer has elastic properties that dampen noise. A part may be covered by a fabric also to dampen noise.

FIGS. 1-3 further illustrate that the hands-free bow holder 10 plate member may be covered by one or more fabric portions.

FIGS. 1-3 further illustrate that the hands-free bow holder 10 leg strap 120 may be elastic.

FIGS. 1-3 further illustrate that the hands-free bow holder 10 stop members 160A and 160B may be polymer covered, there being disposed on the plate member 100 at least one or more of a bottom stop member 160A and a top stop member 160B for respective carriage member 130 open and closed states, the bottom stop member 160A retaining the carriage member 130 substantially perpendicular to the plate member 100.

Figure 4A:
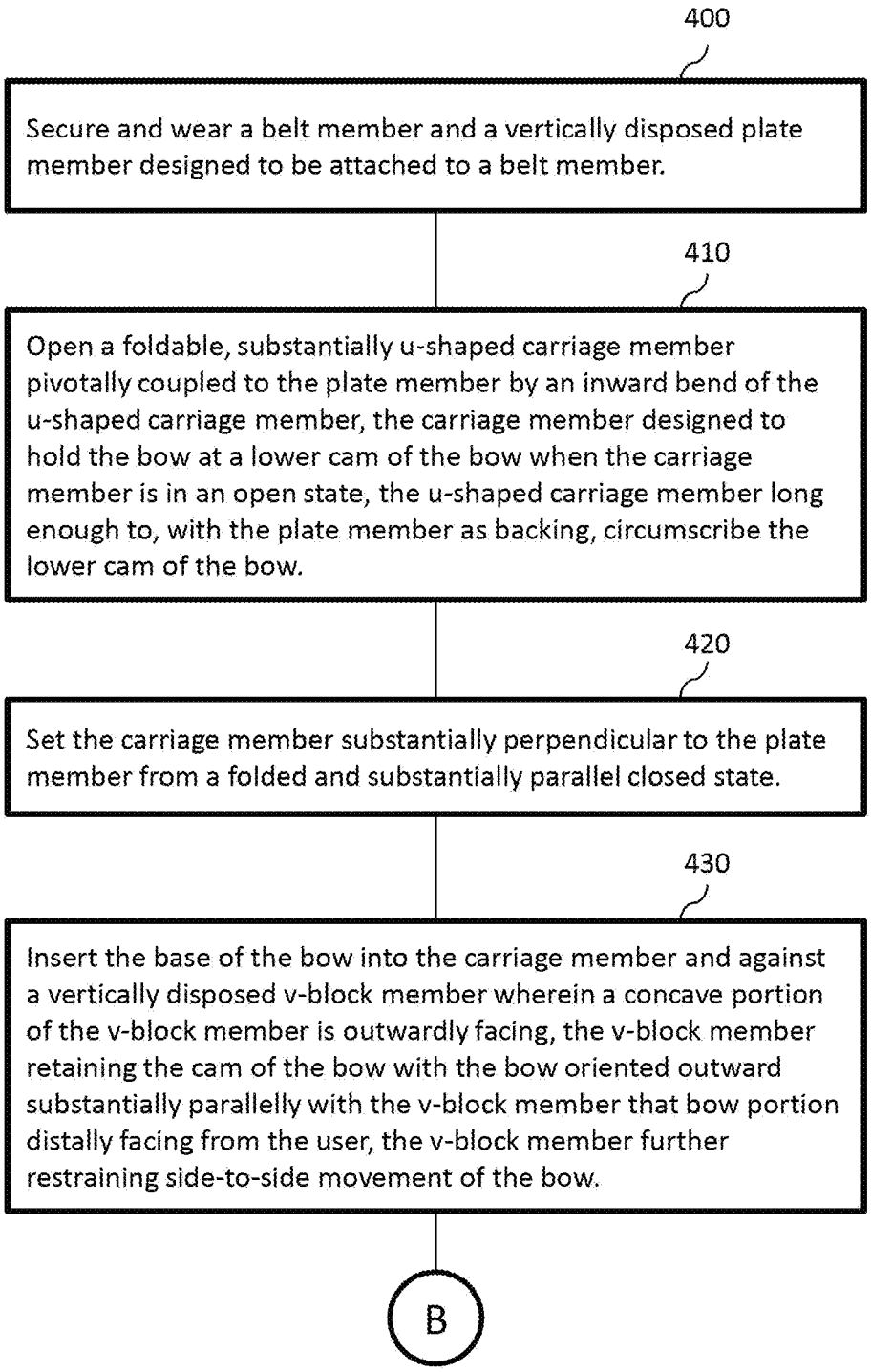
FIG. 4A-4B illustrates a represented method for using the hands-free bow holder.
Figure 4B:
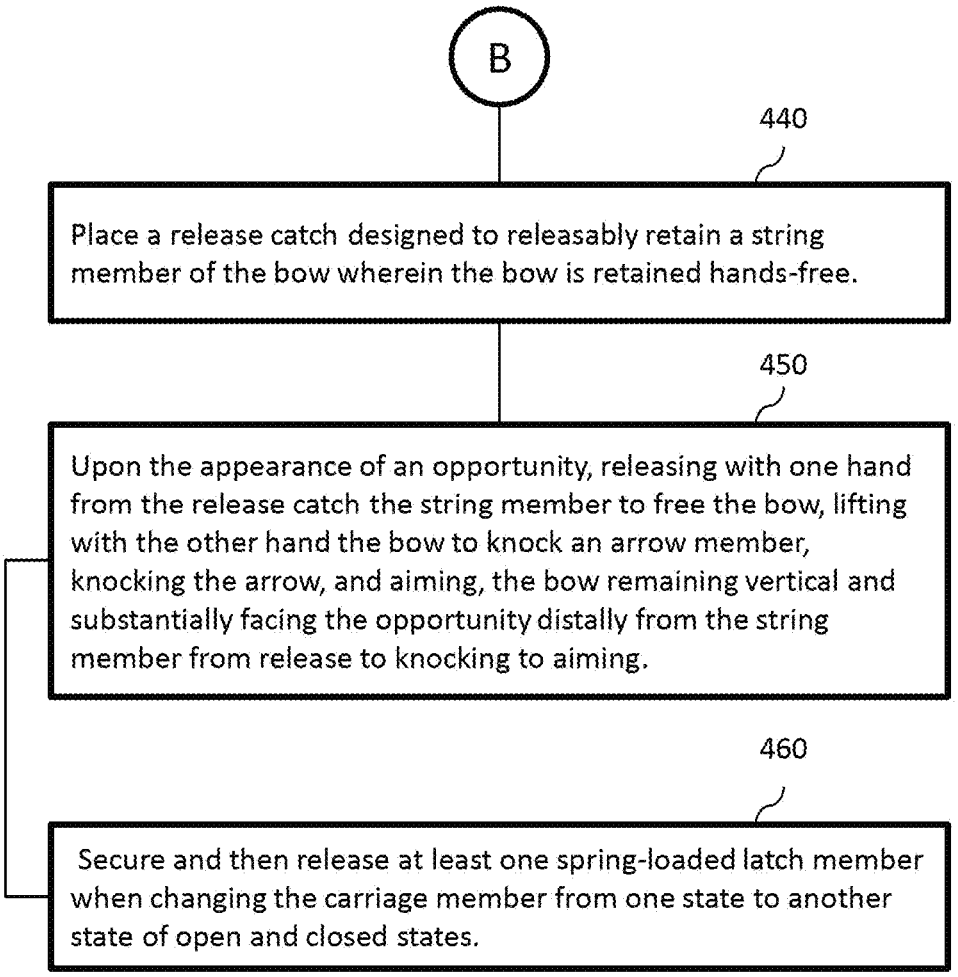

Further disclosed in FIGS. 4A-4B is a method for using a hands-free bow holder 10, the method including the step of 400 securing and wearing a belt member 110 and a vertically disposed plate member 100 designed to be attached to a belt member. The method further includes the step of 410, opening a foldable, substantially u-shaped carriage member 130 pivotally coupled to the plate member 100 by an inward bend of the u-shaped carriage member 130, the carriage member 130 designed to hold the bow at a lower cam of the bow when the carriage member 130 is in an open state, the u-shaped carriage member 130 long enough to, with the plate member 100 as backing, circumscribe the lower cam of the bow.

The method further includes the step of 420, setting the carriage member 130 substantially perpendicular to the plate member 100 from a folded and substantially parallel closed state. The method further includes the step of 430, inserting the base of the bow into the carriage member 130 and against a vertically disposed v-block member 150 wherein a concave portion of the v-block member 150 is outwardly facing, the v-block member 150 retaining the cam of the bow with the bow oriented outward substantially parallelly with the v-block member 150 that bow portion distally facing from the user, the v-block member 150 further restraining side-to-side movement of the bow.

The method further includes the step of 440, placing a release catch 170 designed to releasably retain a string member of the bow wherein the bow is retained hands-free. The method further includes the step of 450, upon the appearance of an opportunity, releasing with one hand from the release catch 170 the string member to free the bow, lifting with the other hand the bow to knock an arrow member, knocking the arrow, and aiming, the bow remaining vertical and substantially facing the opportunity distally from the string member from release to knocking to aiming.

The method for using a hands-free bow holder 10 may further including the step of 460, securing and then releasing at least one spring-loaded latch member when changing the carriage member 130 from one state to another state of open and closed states.

The following patents are incorporated by reference in their entireties: U.S. Pat. Nos. 4,103,807, 4,282,849, 4,684,047, 4,705,015, 5,038,987, 5,165,584, 5,243,957, 5,243,959, 5,246,154, 5,497,512, 6,591,825, 6,948,690, 7,290,689, 7,527,182, 7,798,137, 8,161,956, 8,336,746, 8,814,018, 8,899,217, U.S. Ser. No. 11/009,308, US20120043362A1, and US20220082350A1.

While inventive concepts have been described above in terms of specific embodiments, it is to be understood that the inventive concepts are not limited to these disclosed embodiments. Upon reading the teachings of this disclosure, many modifications and other embodiments of the inventive concepts will come to mind of those skilled in the art to which these inventive concepts pertain, and which are intended to be and are covered by both this disclosure and the appended claims. It is indeed intended that the scope of the inventive concepts should be determined by proper interpretation and construction of the appended claims and their legal equivalents, as understood by those of skill in the art relying upon the disclosure in this specification and the attached drawings.

The invention claimed is:

1. A method for using a hands-free bow holder, the method comprising:

securing and wearing a belt member and a vertically disposed plate member adapted to be attached to a belt member; opening a foldable, substantially u-shaped carriage member pivotally coupled to the plate member by an inward bend of the u-shaped carriage member, the carriage member adapted to hold the bow at a lower cam of the bow when the carriage member is in an open state, the u-shaped carriage member long enough to, with the plate member as backing, circumscribe the lower cam of the bow;

setting the carriage member substantially perpendicular to the plate member from a folded and substantially parallel closed state;

inserting the base of the bow into the carriage member and against a vertically disposed v-block member wherein a concave portion of the v-block member is outwardly facing, the v-block member retaining the cam of the bow with the bow oriented outward substantially parallelly with the v-block member that bow portion distally facing from the user, the v-block member further restraining side-to-side movement of the bow;

placing a release catch adapted to releasably retain a string member of the bow wherein the bow is retained hands-free; and upon the appearance of an opportunity, releasing with one hand the string member from the release catch to free the bow, lifting with the other hand the bow to knock an arrow member, knocking the arrow, and aiming, the bow remaining vertical and substantially facing the opportunity distally from the string member from release to knocking to aiming.

2. The method for using a hands-free bow holder of claim 1, the method further including securing and then releasing at least one spring-loaded latch member when changing the carriage member from one state to another state of open and closed states.

* * * * *